US007711280B2

(12) United States Patent
Matsuda et al.

(10) Patent No.: US 7,711,280 B2
(45) Date of Patent: May 4, 2010

(54) IMAGE FORMING APPARATUS, FIXATION DEVICE AND HEAT CONTROL METHOD FOR A FIXATION DEVICE

(75) Inventors: Yuji Matsuda, Tokyo (JP); Manabu Kodama, Tokyo (JP)

(73) Assignee: Ricoh Company, Ltd., Tokyo (JP)

( * ) Notice: Subject to any disclaimer, the term of this patent is extended or adjusted under 35 U.S.C. 154(b) by 665 days.

(21) Appl. No.: 11/551,552

(22) Filed: Oct. 20, 2006

(65) Prior Publication Data

US 2007/0092278 A1 Apr. 26, 2007

(30) Foreign Application Priority Data

Oct. 25, 2005 (JP) ..... 2005-310103
Oct. 31, 2005 (JP) ..... 2005-316996

(51) Int. Cl.
*G03G 15/20* (2006.01)

(52) U.S. Cl. ..... 399/69

(58) Field of Classification Search ..... 399/67, 399/68, 69, 94
See application file for complete search history.

(56) References Cited

U.S. PATENT DOCUMENTS

| | | | | |
|---|---|---|---|---|
| 5,928,551 | A | 7/1999 | Okabayashi | |
| 6,246,843 | B1 | 6/2001 | Nanataki et al. | |
| 7,167,657 | B2 * | 1/2007 | Inoue et al. | 399/94 X |
| 7,218,874 | B2 * | 5/2007 | Tomiyori et al. | 399/68 |
| 7,298,985 | B2 * | 11/2007 | Nihonyanagi et al. | 399/69 |
| 2003/0155349 | A1 | 8/2003 | Matsuo et al. | |

FOREIGN PATENT DOCUMENTS

| | | |
|---|---|---|
| EP | 1 510 885 A2 | 3/2005 |
| JP | 60 170872 A | 9/1985 |
| JP | 5-333740 | 12/1993 |
| JP | 7-281550 | 10/1995 |
| JP | 9-54519 | 2/1997 |
| JP | 9-68885 | 3/1997 |
| JP | 9-106208 | 4/1997 |
| JP | 10-198215 | 7/1998 |
| JP | 11-65330 | 3/1999 |
| JP | 2000-122467 | 4/2000 |
| JP | 2002-237377 | 8/2002 |
| JP | 2004 212601 A | 7/2004 |

* cited by examiner

*Primary Examiner*—Sandra L Brase
(74) *Attorney, Agent, or Firm*—Oblon, Spivak, McClelland, Maier & Neustadt, L.L.P.

(57) ABSTRACT

An image forming apparatus comprising a fixation device having a heating part for heating and fixing a toner image formed on a recording medium is provided, which comprises a rotational velocity detecting part for detecting a rotational velocity of a conveyance roller for conveying the recording medium and a control part for estimating a surface temperature of the recording medium based on the rotational velocity of the conveyance roller detected by the rotational velocity detecting part, for estimating a temperature change of the heating part at a time of fixation based on the estimated surface temperature, and for determining a heating control variable of the heating part based on the temperature change.

12 Claims, 11 Drawing Sheets

IMAGE FORMING APPARATUS, FIXATION DEVICE AND HEAT CONTROL METHOD FOR A FIXATION DEVICE

BACKGROUND OF THE INVENTION

1. Field of the Invention

The present invention relates to an image forming apparatus, a fixation device and a heat control method for a fixation device.

2. Description of the Related Art

In an image forming apparatus such as a copying machine, a printer, and a facsimile machine, an image is fixed on a recording medium by transcribing a toner image formed on a photoconductor drum onto a transcription paper as a recording medium and, subsequently applying a heating treatment on it by a fixation roller of a fixation device which roller is referred to as a heating roller. In the fixation device, a fixation roller heated by a heat generation member such as a halogen heater and a member heated by means of electromagnetic induction (a roller with heating means is referred to as a fixation roller, below.) and a pressurizing roller arranged to oppose the fixation roller are pressurized by and contacted to each other so as to form a mutual pressurizing and contacting part referred to as a nip part, and the recording medium on which a toner image has been transcribed passes through and heated at the nip part.

A thermistor as a contact-type temperature sensor is configured to contact a fixation roller and fixation failure caused by temperature non-uniformity on the fixation roller is prevented by measuring the temperature of the fixation roller by using the thermistor and controlling the temperature of a heat generation member so that the surface temperature of the fixation roller is constant. However, in the first printing after turning on a power supply, when printing is performed on the condition that a transcription paper and toner have been cooled, the heat of the fixation roller transmits to the transcription paper at the time of fixation and, therefore, the temperature of a nip part is lowered, whereby there is a problem such that non-uniformity of fixation occurs. Particularly, the lowering of the temperature of the nip part is significant in the case of performing printing under a low-temperature environment and non-uniformity of fixation easily occurs.

Commonly, in order to prevent such temperature lowering, it is possible to prevent the temperature lowering through paper passage by increasing the thickness of a fixation roller thereby increasing the heat capacity thereof.

However, if the thickness of the fixation roller is increased, it takes starting time period until it reaches a certain temperature at the time of heat generation and a time period for providing a printable condition is required from turning on a power supply, whereby there is a problem of degrading the use convenience of a user. As a method for reducing the starting time period, there is provided a method for providing a pressurizing roller with an auxiliary heater so as to compensate the temperature lowering caused by paper passage, but, in this case, a certain cost of a heater, a certain capacity of a power supply, and further a driver for driving an auxiliary heater are needed thereby increasing the cost and there is a problem of consuming extra energy.

Then, for example, it is suggested to prevent a temporary lowering of the surface temperature of a fixation roller by heating the fixation roller and a transcription paper using infrared rays generated from a halogen electric bulb in Japanese Laid-Open Patent Application No. 09-054519. Also, it is suggested to prevent a temporary lowering of the surface temperature by heating an intermediate transcriber and toner using a heat pipe in Japanese Laid-Open Patent Application No. 11-065330.

On the other hand, commonly, it is possible to prevent temperature lowering caused by paper passage by increasing the thickness of a fixation roller and increasing the heat capacity thereof in order to prevent the temperature lowering. However, if the thickness of a fixation roller, it takes starting time period until it reaches a certain temperature at the time of heat generation and a time period for providing a printable condition is required from turning on a power supply, whereby the use convenience of a user is degraded. Then, as a method for reducing the starting time period, there is provided a method for providing a pressurizing roller with an auxiliary heater so as to compensate the temperature lowering caused by paper passage. However, in this case, a certain cost of a heater, a certain capacity of a power supply, and further a driver for driving an auxiliary heater are needed thereby increasing the cost and there is a problem of consuming extra energy.

Therefore, it is necessary to reduce starting time period until it reaches a certain temperature at the time of heat generation by reducing the thickness of a fixation roller, but, as described above, particularly in the first printing under a low-temperature environment, when printing is performed on the condition that a transcription paper and toner have been cooled, the temperature of a nip part is lowered, whereby there is a problem such that non-uniformity of fixation occurs. In this case, since the temperature is changed like a transient response, even if the temperature is detected by a thermistor after the temperature is changed, some time period is practically required until the temperature reaches a target temperature by raising heating temperature and it cannot be followed in a response time.

There are problems of increasing the cost as described above in the prevention of temporary temperature lowering at the time of fixation by previously heating a transcription paper, toner or an intermediate transcriber by a heat pipe or other means as the conventional techniques described above, and of increasing a apparatus surface area for configuring them.

Therefore, it is necessary to reduce starting time period required for reaching a certain temperature at the time of heat generation by reducing the thickness of a fixation roller, but, as described above, if printing is performed at the condition that a transcription paper or toner have been cooled, the temperature of a nip part is lowered, whereby there is a problem such that non-uniformity of fixation occurs. In this case, since the temperature is changed like a transient response, the following control is hardly conducted in the transient time by the temperature control using a thermistor.

As notice of the problem of such a conventional technique is taken, it is desired to suppress degradation of image quality caused by temporal lowering of surface temperature of a fixation roller or degradation of image quality under a lower temperature environment.

Meanwhile, as such a technique, for example, a conventional technique disclosed in Japanese Laid-Open Patent Application No. 2002-237377 is known. The conventional technique disclosed in Japanese Laid-Open Patent Application No. 2002-237377 aims at providing a fixation device with a high fixation performance which satisfies the reduction of reactive current provided on commercial alternating current, the prevention of audible frequency noise, constant heating output with an inexpensive structure and an image forming apparatus with a high fixation performance and little image quality degradation. Then, it is an electrically inductive heating method which chops and applies direct current obtained by rectification of alternating current to a resonant circuit including an electric coil arranged in vicinity to an object to be heated and a capacitor for resonance connected thereto by the repetition of switching on and off of a switching element, characterized by detecting the variation of a voltage between the resonant circuit and the switching element so as to switch on the switching element in synchronization with it and detecting current through the switching element so that it switches off the switching element after an on-time based on the time required for reaching an instantaneous value of an envelop level proportional to a voltage wave pattern obtained by the rectification of the alternating current.

Meanwhile, an inverter is used in the conventional technique which includes a fixation device disclosed in Japanese Laid-Open Patent Application No. 2002-237377. In such an inverter, a constant OFF time period (P) is necessarily retained and then the duration of an ON time period is adjusted to conduct the electrically inductive heating of a load, herein a heated part of a fixation roller, as shown in FIGS. 13 (*a*) and (*b*).

However, when driving pulses as shown in FIG. 13 (*b*) is turned off, a resonance voltage is generated between both terminals of a switching element. Commonly, a control to retain an OFF time period (P) which is longer than the duration time of the resonance voltage is conducted. The relationship between the resonance voltage and the switching off in this case is shown in FIGS. 14 (*a*) and (*b*). Thus, when the control to retain the OFF time period (P) is conducted and a control part encounters a difficulty, and further, when the switch is turned on at the time of generation of a resonance voltage as shown in FIG. 14 (*b*), the resonance is consequently enhanced and a lot of stress is generated in the switching element, which may lead to the breaking thereof if the worst happens.

As notice of the problem of such a conventional technique is taken, it is desired to prevent a switching element from breaking.

SUMMARY OF THE INVENTION

According to one aspect of the present invention, there is provided an image forming apparatus comprising a fixation device having a heating part configured to heat and fix a toner image formed on a recording medium, which comprises a rotational velocity detecting part configured to detect a rotational velocity of a conveyance roller configured to convey the recording medium and a control part configured to estimate a surface temperature of the recording medium based on the rotational velocity of the conveyance roller detected by the rotational velocity detecting part, to estimate a temperature change of the heating part at a time of fixation based on the estimated surface temperature, and to determine a heating control variable of the heating part based on the temperature change.

According to another aspect of the present invention, there is provided a method of controlling heating of a fixation device having a heating part configured to heat and fix a toner image formed on a recording medium, which comprises detecting a rotational velocity of a conveyance roller configured to convey the recording medium, estimating a surface temperature of the recording medium based on the detected rotational velocity of the conveyance roller, estimating a temperature change of the heating part at a time of fixation based on the estimated surface temperature, and determining a heating control variable of the heating part based on the estimated temperature change.

According to another aspect of the present invention, there is provided a fixation device comprising an electrically inductive heating part configured to generate a driving wave pattern for a switching element by a control part in a control section thereof and to transmit the driving wave pattern to a driving section thereof by a signal transmitting part having an insulating function provided between the driving section and the control section, which comprises a part configured to retain a certain or longer off-time period of a driving pulse for the switching element, in the control section.

According to another aspect of the present invention, there is provided a fixation device comprising an electrically inductive heating part configured to generate a driving wave pattern for a switching element by a control part in a control section thereof and to transmit the driving wave pattern to a driving section thereof by a signal transmitting part having an insulating function provided between the driving section and the control section, which comprises a part configured to retain a certain or shorter on-time period of a driving pulse for the switching element, in the control section.

According to another aspect of the present invention, there is provided a fixation device comprising an electrically inductive heating part configured to generate a driving wave pattern for a switching element by a control part in a control section thereof and to transmit the driving wave pattern to a driving section thereof by a signal transmitting part having an insulating function provided between the driving section and the control section, which comprises a part configured to imperatively stop an output of a driving pulse when the control part does not function.

According to another aspect of the present invention, there is provided a fixation device comprising an electrically inductive heating part configured to generate a driving wave pattern for a switching element by a control part in a control section thereof and to transmit the driving wave pattern to a driving section thereof by a signal transmitting part having an insulating function provided between the driving section and the control section, which comprises a part configured to imperatively stop an output of a driving pulse when the control part is abnormal.

According to another aspect of the present invention, there is provided a fixation device comprising an electrically inductive heating part configured to generate a driving wave pattern for a switching element by a control part in a control section thereof and to transmit the driving wave pattern to a driving section thereof by a signal transmitting part having an insulating function provided between the driving section and the control section, which comprises a part configured to detect a resonance voltage wave pattern in the control part by using the signal transmitting part having an insulating function.

According to another aspect of the present invention, there is provided an image forming apparatus comprising the fixation device according to one aspect of the present invention.

DETAILED DESCRIPTION OF THE PREFERRED EMBODIMENTS

Figure 1:
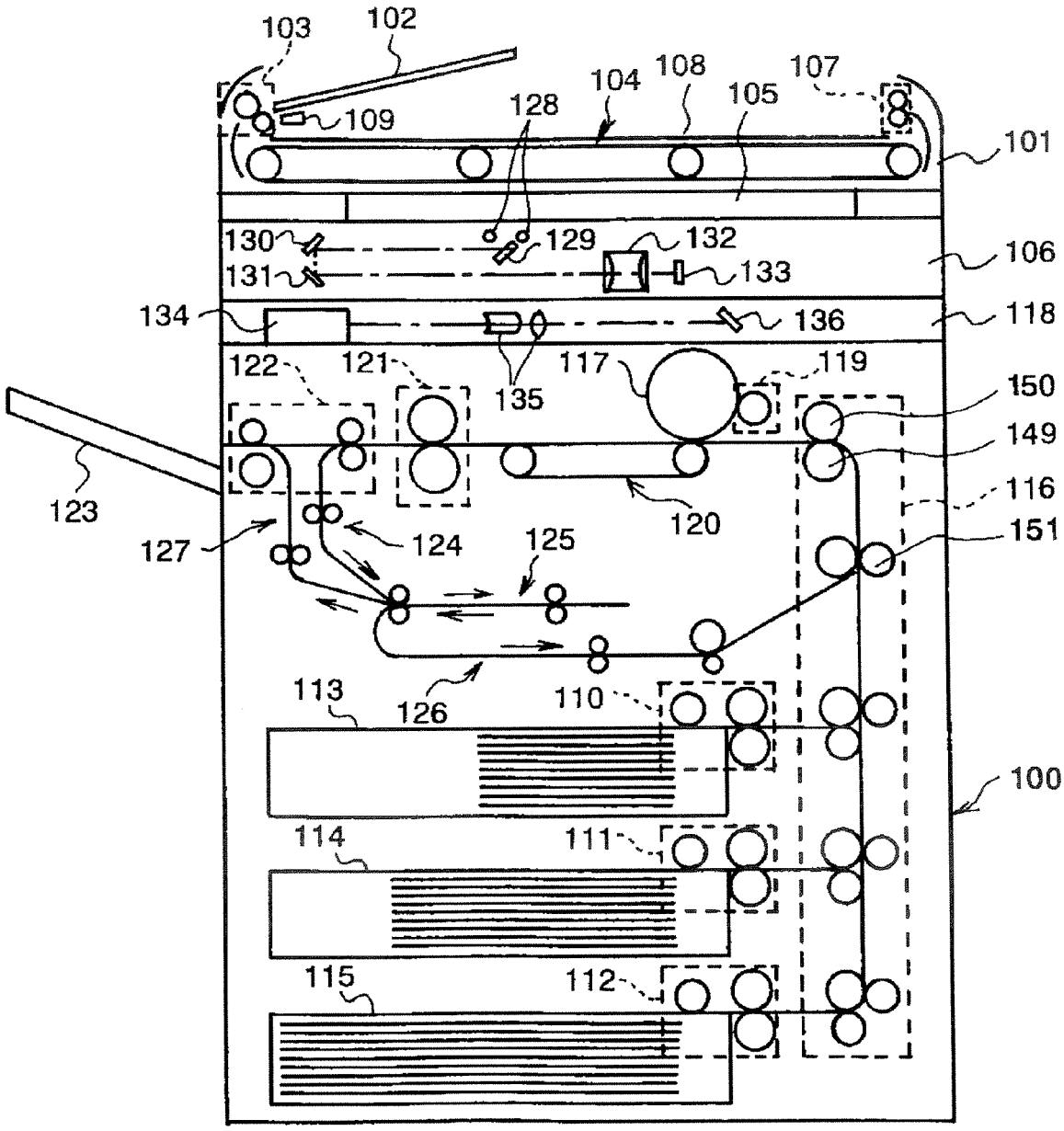
FIG. 1 is a schematic diagram showing the entire system configuration of an image forming apparatus according to an embodiment of the present invention.

The preferred embodiments of the present invention are described with reference to the drawings below.

First Embodiment

In the first embodiment of the present invention, a transcription paper 207, a heater 203, a fixation device 121, a resist roller 149 and driven rollers 150 (and 151), the combination of a timer 704 and a sensor 302 or 401, a CPU 701, a timer 704, a flag 302*a*, the combination of a light-emitting element 302*b* and a light-receiving element 302*c*, the combination of a light-emitting element 401*b* and a light-receiving element 401*c*, and a ROM 702 are used as a recording medium, a heating part, a fixation device, conveyance rollers, a rotational velocity detecting part, a control part, a counting part, a light blocking member, a detecting part, a slit detecting part, and a storage part, respectively.

FIG. 1 is schematic diagram showing the entire system configuration of an image forming apparatus according to the first embodiment of the present invention. The image forming apparatus according to the first embodiment of the present invention is an example of a multiple function processing machine having a copying function and another function such as a printer function and a facsimile function. The coping function, printer function and facsimile function of the multiple function processing machine can be appropriately switched and selected by using an application switching key of an operation part which is not shown in the figure. That is, a copying mode, a printer mode, and a facsimile mode are conducted in the cases of selection of the copying function, the printer function, and the facsimile function, respectively.

The image forming apparatus is provided for forming a monochrome image and basically composed of a body 100, a writing unit 118 mounted on the top of the body 100, an image reading device 106 mounted on the writing unit 118, and further, an automatic document feeding device 101 (referred to as an "ADF", below) mounted thereon.

The copying mode is conducted as follows. A stack of papers are put on a document table 102 of the ADF 101 such that an image surface is directed upward, and when a start key on the operation part (which is not shown in the figure) is pushed down, a bottom document is fed to a predetermined location on a document table 105 composed of a contact glass by using a feeding roller 103 and a feeding belt 104. The ADF 101 has a counting function for counting up the number of documents every time when the feeding of a piece of document is completed. After image information of a document on the contact glass 105 is read by the image reading device 106 as an image input part, it is ejected onto a paper ejection table 108 by using the feeding belt 104 and an ejection roller 107.

When a next document lying on the document table 102 is sensed by a document set sensor 109, a bottom document on the document table 102 is similarly fed to the predetermined location on the contact glass 105 by using the feeding roller 103 and the feeding belt 104. The feeding roller 103, the feeding belt 104, and the ejection roller 107 are driven by a conveyance motor (which is not shown in the figure).

While the image reading device 106 illuminates a document on the contact glass 105 by using two lamps 128 for illuminating it and moves in a sub-scanning direction, the document is read by line-scanning it, reflecting reflected light therefrom to a predetermined direction via a first mirror 129, a second mirror 130, and a third mirror 131, and imaging an reduced image onto CCD image sensor 133 as a photoelectric converter via a lens unit 132.

While image data are read from the document by using the image reading device 106, light-writing is conducted based on a document image by using an image processing part which is not shown in the figure and the writing unit 118 as a writing part and a latent image is formed on a photoconductor drum 117. The writing unit 118 is composed of a laser light-emitting device 134, an f-θ lens 135, a reflecting mirror 136, etc. Additionally, an exposure light source is laser light but not limited to it, and may be, for example, an LED array, etc.

The body 100 is composed of the photoconductor drum 117, a development device 119, the fixation device 121, a paper ejection unit 122, first through thirds paper feeding device 110-112, a vertical conveyance unit 116, etc. The photoconductor drum 117 is uniformly charged by an electrical charger which is not shown in the figure and subsequently light-exposed to light with information from the writing unit 118 so as to form a latent image. The latent image on the photoconductor drum 117 is developed is developed by the development device 119 so as to provide a toner image.

A conveyance belt 120 is provided below the photoconductor drum 117. The conveyance belt 120 is used as both a conveyance part for a transcription paper as a recording medium and a transcription part, on which a transcription bias voltage is applied from a power supply (which is not shown in the figure), and while the transcription paper 207 conveyed from the vertical conveyance belt 116 and sent by the resist roller 149 is conveyed at the same speed as the rotational velocity of the photoconductor drum 117, the toner image on the photoconductor drum 117 is transcribed on the transcription paper 207. A toner image 206 on the transcription paper 207 (in FIG. 2) is fixed by the fixation device 121, which is ejected from the ejection paper unit 122 onto an ejection paper tray 123. The photoconductor drum 117 is cleaned by a cleaning device which is not shown in the figure after the transcription of the toner image. Herein, the photoconductor drum 117, the electrical charger, the writing unit 118, the development device 119, and the transcription device constitute an image forming apparatus for forming an image on a transcription paper according to image data. The photoconductor drum 117 is rotationally driven at a certain speed by a main motor. Also, a conveyance roller pair including the resist roller 149 is provided on a route of sending the transcription paper 207 to the photoconductor drum 117. One of the conveyance roller pair is a driving roller and the other is a driven roller. In FIG. 1, a driven roller associated with the resist roller 149 is denoted by a reference numeral of 150 and the driven roller of the conveyance roller pair is denoted by a reference numeral of 151.

The paper ejection unit 122 is provided with a double-face conveyance route. That is, there is provided a reversal conveyance route 125 to which a transcription paper is sent by a conveyance roller pair 124 from the middle of the paper ejection unit 122, an image forming conveyance route 126 for conveying the transcription paper reversed on the reversal conveyance route 125 to the side of the vertical conveyance unit 116 again, and a paper ejection conveyance route 127 for returning the reversed transcription paper to the side of the paper ejection unit 122 again. An image is formed on both faces of the transcription paper on the double face conveyance route, and paper ejection onto the paper ejection tray 123 can be conducted while the face on which an image is formed is faced down.

A first paper feeding device 110, a second paper feeding device 111, and a third paper feeding device 112 as paper feeding devices feed a transcription paper stacked on a first tray 113, a second tray 114, and a third tray 115, respectively, when selection thereof is conducted, and the transcription paper is conveyed to a location at which the photoconductor 117 contacts, by the vertical conveyance unit 116.

In the embodiment of the present invention, at least one of driven rollers in the paper feeding parts on a conveyance route of the transcription paper 207 (for example, a driven roller 150 or 151 described below) is provided with a part for detecting the rotational velocity of the driven roller, so that the rotational velocity of the driven roller is detected during the conveyance of the transcription paper 207. The detection part will be described in detail below.

In addition, on a printing mode, image data from the exterior instead of the image data from an image processing device are input into the writing unit 118 and an image is formed on a transcription paper by an image forming part. Also, on a facsimile mode, image data from the image reading device 106 are transmitted to a partner by a facsimile transceiver which is not shown in the figure, and image data from the partner are received by the facsimile transceiver and input into the writing unit 118 instead of image data from the image processing device, whereby an image is formed on a transcription paper by the image forming device.

Figure 2:
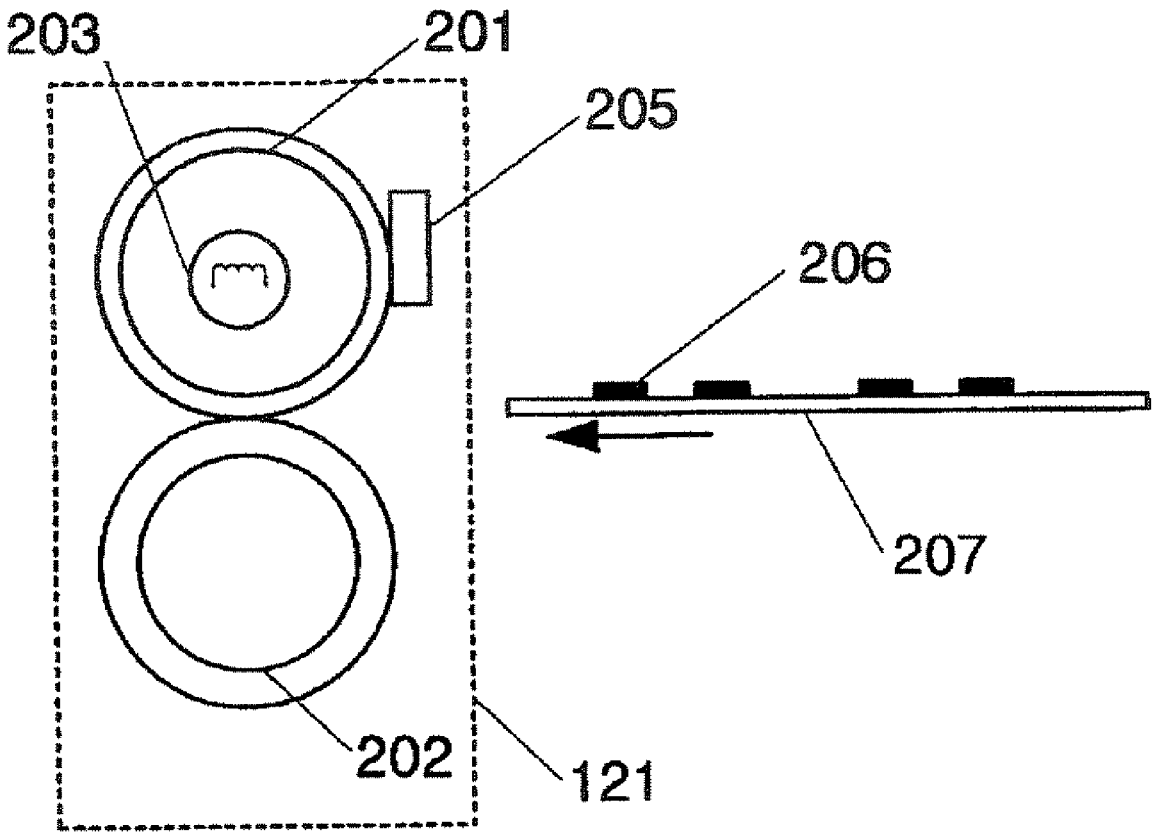
FIG. 2 is a schematic diagram showing the configuration of a fixation device.

FIG. 2 is a schematic diagram showing the configuration of the fixation device 121. In the fixation device 121, the fixation roller 201 as a fixing member is pressed by the pressurizing roller 202 as a pressurizing member at a certain pressure by using a pressurizing pat which is not shown in the figure. The pressurizing roller 202 is composed of an elastic member whose surface is silicone rubber, etc., and has a predetermined elasticity in this embodiment. Since the fixing member and the pressurizing member are commonly and frequently rollers, the rollers are drawn in FIG. 2 but one or both of them may be composed of an endless belt(s). The fixation device 121 has a heater 203 such as a halogen heater and an electrically inductive heating device as a heat source which receives a voltage from an AC power supply and generates heat, and the heater 203 is provided at an arbitrary position at which the fixation roller 201 can be heated whereby, for example, the heater 203 is arranged inside the fixation roller 201 as shown in the figure and the fixation roller 201 is heated from the inside thereof.

The fixation roller 201 and the pressurizing roller 202 are rotationally driven by a driving mechanism which is shown in the figure. A temperature sensor 205 is provided to contact the surface of the fixation roller 201 and sense the surface temperature (fixation temperature) of the fixation roller 201. When the transcription paper 207 as a recording medium which carries toner 206 passes through a nip part between the fixation roller 201 and the pressurizing roller 202, the toner 206 is molten by heating of the fixation roller 201 and a pressure of the pressurizing roller 202 and fixed on the recording medium. In the embodiment of the present invention, the temperature of the heater 203 is controlled depending on the detected value of the temperature sensor 205 so that the surface temperature of the fixation roller 201 is constant as described below, and thus fixation failure caused by temperature ununiformity of the fixation roller 201 is prevented.

Figure 3:
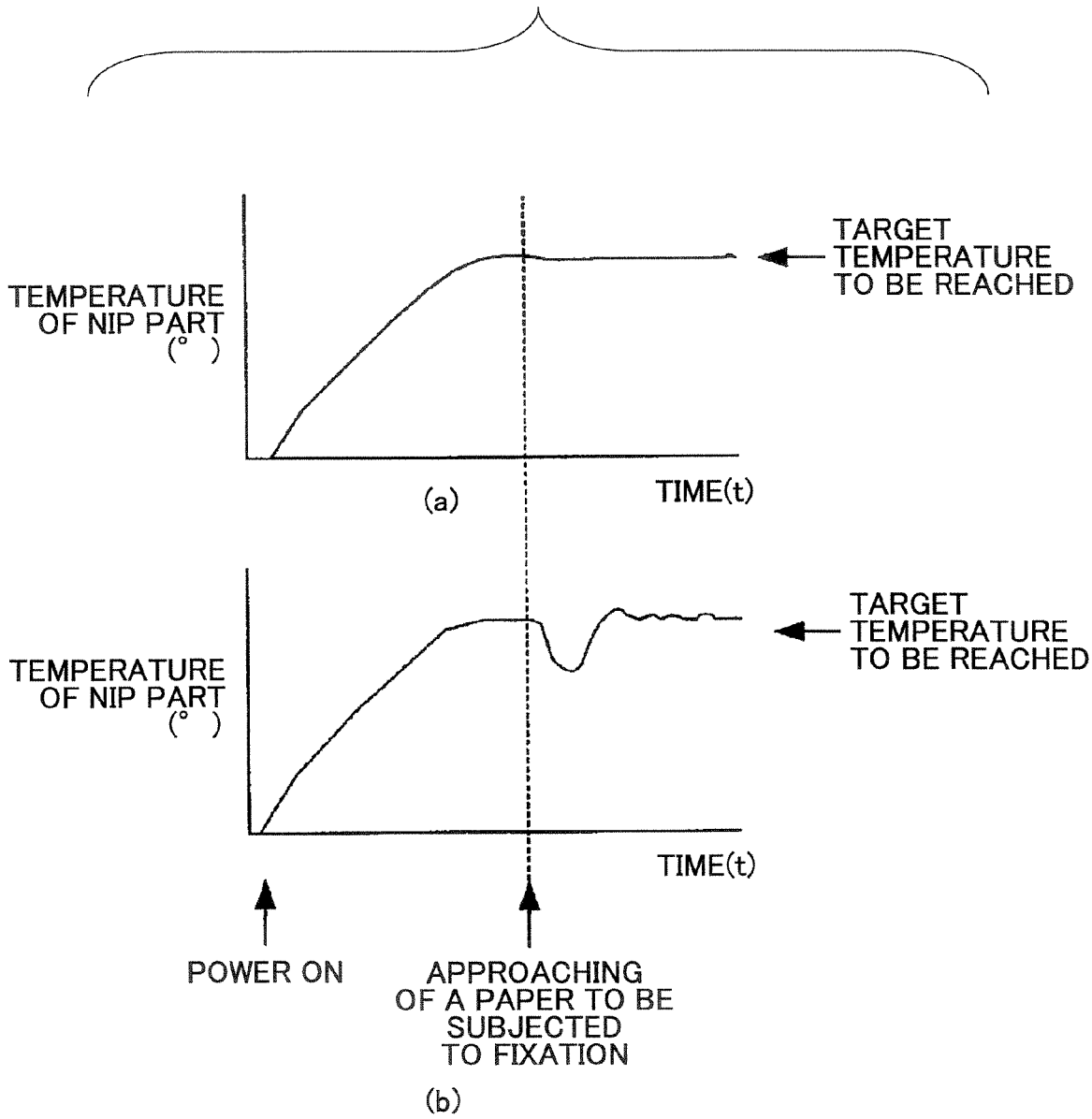
FIG. 3 is a graph showing the temperature change of a nip part between a fixation roller and a pressurizing roller dependent on the temperature of a transcription paper, wherein (a) shows the temperature change under an environment of ordinary temperature and (b) shows an temperature change under the environment of lower temperature.

FIG. 3 is a graph showing the temperature change of a nip part between the fixation roller 201 and the pressurizing roller 202 dependent on the temperature of a transcription paper, wherein (a) shows the temperature change under an environment of ordinary temperature and (b) shows the temperature change under an environment of lower temperature. That is, after the power supply of the body is turned on, the heating of the heater 203 in controlled such that the surface temperature of the fixation roller 201 reaches a target temperature, and after the surface temperature reaches the target temperature, control of printing is started. When paper printing is conducted with the control of printing, it can be seen that the variation of the temperature which is caused by paper printing is small under an environment of ordinary temperature as shown in FIG. 3 (*a*) whereas the variation of the temperature is large under an environment of lower temperature as shown in FIG. 3(*b*). This is why the heat of the fixation roller 201 transfers to the transcription paper 207 at the time of fixation where paper printing is conducted under a condition such that the transcription paper 207 and the toner 206 have been cooled.

This depends on the relationship between the thickness and heat capacity of the fixation roller, as described above. Therefore, in the embodiment of the present invention, the processes of:

1) the conveyance velocity of the transcription paper 207 is detected on the conveyance route for a transcription paper as provided by the vertical conveyance unit 116 described above;

2) the temperature change of the transcription paper 207 is estimated in real time based on the detected conveyance velocity; and 3) temperature lowering at the time of fixation is further estimated based on the temperature of a transcription paper to preliminarily correct the temperature of the fixation roller 201 (to control it to be higher)

are conducted, so that the temporal lowering of the temperature of the nip part is prevented even though the thickness of the fixation roller 201 is small.

Figure 4:
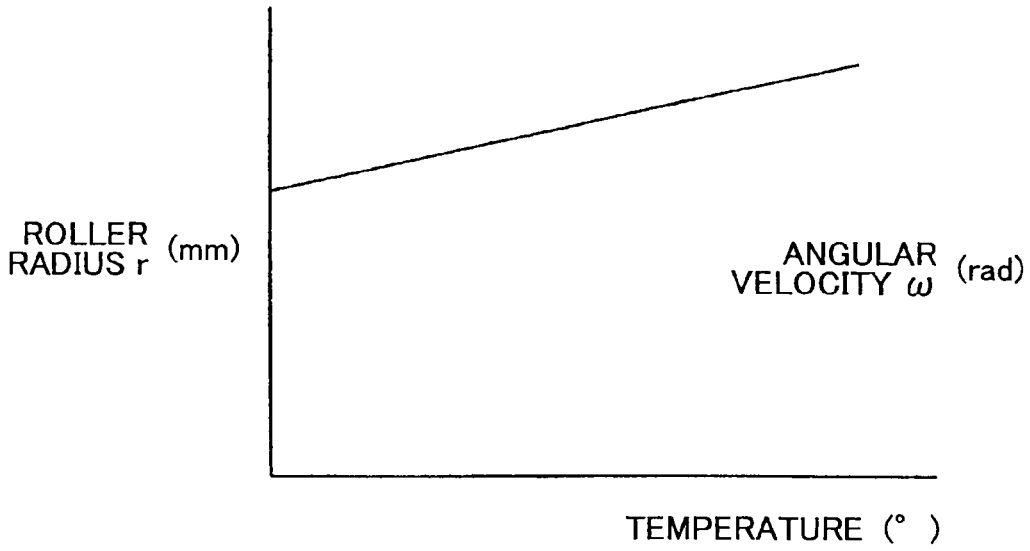
FIG. 4 is a graph showing the relationship between the diameter and temperature of a conveyance roller.

FIG. 4 is a graph showing the relationship between the diameter and temperature of a conveyance roller. That is, the conveyance roller is commonly made of a metal with a high heat-conductivity such as aluminum, and, in the case of a metal roller, as shown in FIG. 4, it has characteristics such that the radius r of the roller decreases if the temperature is low, whereas the radius r of the roller increases if the temperature is high.

On the other hand, the following relationship:

$$\omega = V/r$$

is satisfied among the conveyance velocity V of the transcription paper 207, the radius r and rotational angular velocity ω of the driven roller.

Herein, when the conveyance velocity of the transcription paper 207 is constant, the rotational angular velocity ω of the driven roller increases if the roller radius r of the driven roller decreases, whereas the rotational angular velocity ω of the driven roller increases decreases if the roller radius r of the driven roller increases.

Figure 5:
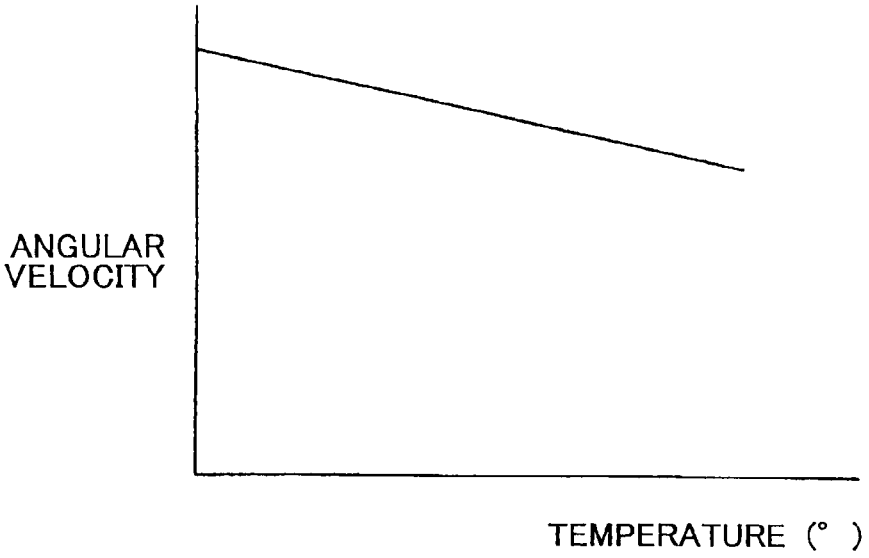
FIG. 5 is a graph showing the relationship between the angular velocity and temperature of a driven roller.

In other words, the rotational velocity of the driven roller increases if the temperature is lowered, whereas the rotational velocity of the driven roller decreases if the temperature is raised, as shown in FIG. 5. FIG. 5 is a graph showing the relationship between the angular velocity and temperature of a driven roller.

For this reason, it can be seen that the temperature of the transcription paper 207 can be estimated by monitoring the rotational velocity of the conveyance roller on the conveyance route for the transcription paper 207. Furthermore, since it can be empirically estimated how much temperature lowering is caused based on the temperature of the transcription paper 207, it is possible to prevent the temperature lowering at the time of paper printing if the temperature of the heater 203 is controlled depending on the rotational velocity of the driven roller.

Figure 6:
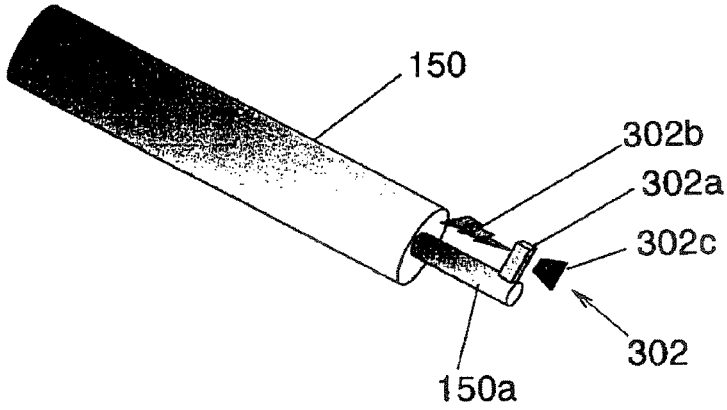
FIG. 6 is a perspective view that schematically shows one example of a driven roller.

FIG. 6 is a perspective view that schematically shows one example of a driven roller. A sensor 302 for sensing one conveyance roller pair is provided to the driven roller 150 in one conveyance roller pair (herein, including the resist roller 149) among the plural conveyance roller pairs in the vertical conveyance unit 116 which provides one conveyance route for the transcription paper 207. The sensor 302 is composed of a flag 302*a* for sensing each rotation of the driven roller 150 attached to a shaft 150*a* of the driven roller 150, a light-emitting element 302*b* arranged to irradiate the flag 302*a* with light, and a light-receiving element 302*c* arranged to receive light from the light-emitting element 302*b*, and is a so-called photo-interrupter-type sensor for sensing the rotation of the flag 302*a* by blocking light from the light-emitting element 302*b* by using the rotating flag 302*a*. As the rotation is detected by the flag 302*a*, a pulse signal is output from the sensor 302.

Figure 7:
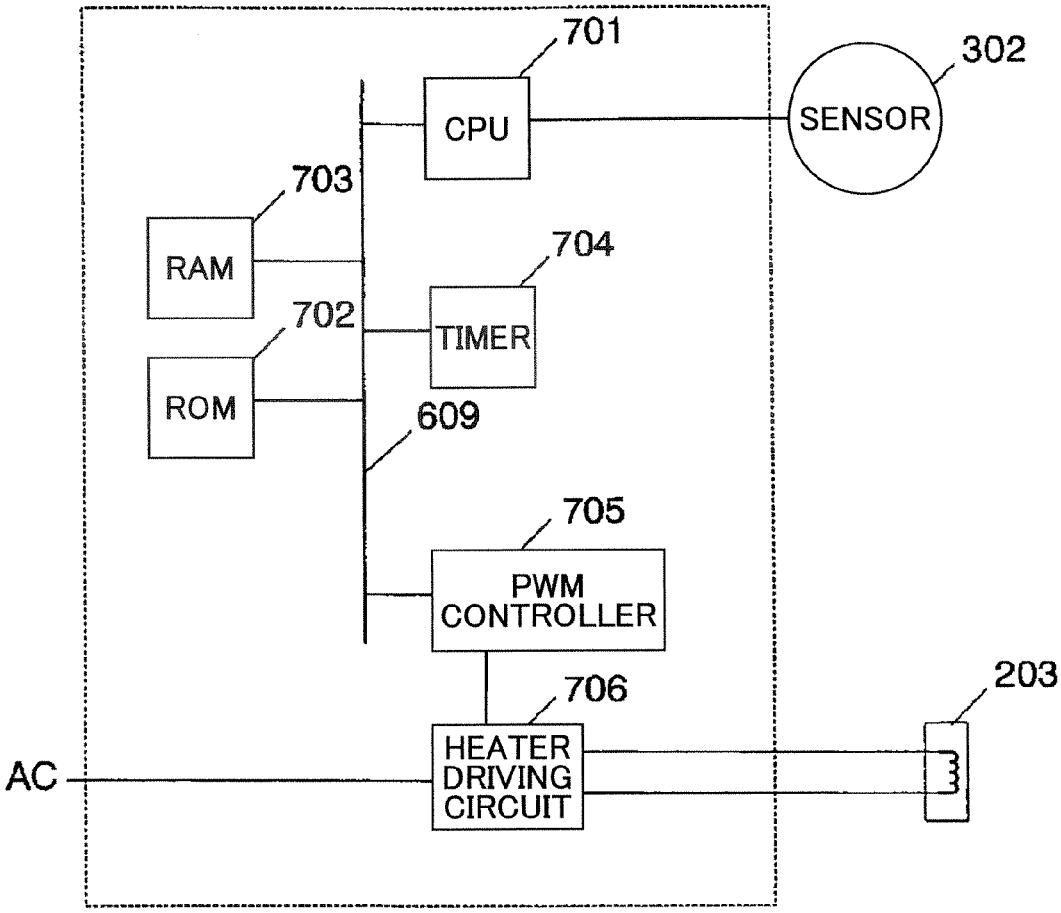
FIG. 7 is a block diagram showing a temperature control circuit of a fixation device.

FIG. 7 is a block diagram showing a temperature control circuit of a fixation device. The temperature control circuit is composed of a CPU 701 for conducting the control of the entire of the image forming apparatus as well as the control of the receipt of image data signal input from an exterior device which is not shown in the figure and transmission and receipt of a control command signal, a ROM 702 in which a program is stored, a RAM 703 used as a work memory, a timer 704 for conducting a timing measurement, a PWM controller 705 for generating a heater control signal and a heater driving circuit 706. The CPU 701, the ROM 702, the RAM 703, the timer 704, and the PWM controller 705 are interconnected via a bus interface 609, which enables the read-write processing of data and the performance of control according to an instruction from the CPU 701.

An output from the sensor 302 attached to the driven roller 150 in the vertical conveyance unit 116 is input into the CPU 701 as interruption. Also, the timer 704 has a configuration to repeat a count-up operation for each of certain time period, to conduct zero clear according to an instruction of the CPU 701, and to be readable of a count value in the CPU 701. An interruption signal from the sensor 302 is input into the CPU 701 for each rotational time period of the driven roller 150, a count value is acquired from the timer 704 for each interruption input, and an operation for zero-clear is conducted after the acquisition. Then, the count value acquired from the timer 704 indicates one time period of the driven roller 150.

Figure 8:
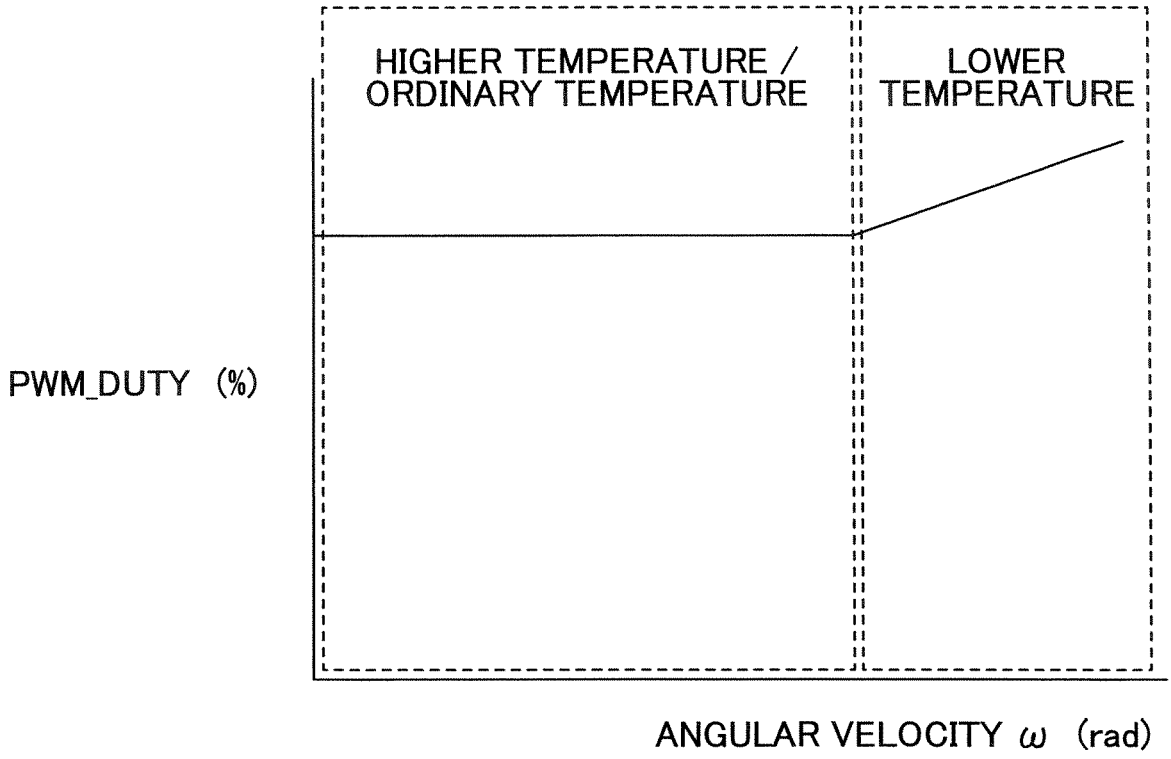
FIG. 8 is a diagram showing a conversion table between the rotational velocity of a driven roller and the control variable of a fixation heater.

Also, the driven roller 150 has a characteristic of increasing or decreasing the roller radius depending on the temperature at the time of conveying the transcription paper 207 as described above, and it is empirically possible to estimate the temperature of the transcription paper 207 based on the rotational velocity of the driven roller 150, as seen in FIG. 5. Furthermore, it is empirically possible to estimate the variation of fixation temperature of the driven roller 150 from the temperature of the transcription paper 207. Then, based on them, a conversion table between the rotational velocity of the driven roller and a control variable of a fixation heater as shown in FIG. 8 is created and stored in the ROM 702. A control is conducted such that the control variable of the fixation heater is varied based on the conversion table between the rotational velocity of the driven roller and the control variable of the timer 704 and a time period of one rotation of the driven roller which is acquired by the timer 704 before the transcription paper 207 enters the fixation roller 201.

When the transcription paper 207, itself, is at lower temperature, the temperature of the nip part is lowered at the time of approaching the fixation roller 201. Hence, as described above, when the rotational velocity of the driven roller 150 is large, FIG. 5 shows that the temperature is low, and therefore, control is made such that the temperature of the nip part is not lowered and the duty of the PWM is high. Thus, when the transcription paper 207 approaches the fixation roller 201, fixation failure is prevented by preliminarily raising the fixation temperature.

On the other hand, when the transcription paper 207, itself, is at higher temperature or ordinary temperature, the temperature of the nip part is not lowered even if it approaches the fixation roller 201. Therefore, as described above, when the rotational velocity of the driven roller 150 is small, the duty of the PWM is controlled by a conventional value since FIG. 6 shows that the temperature is high.

Also, the PWM controller 705 is connected to the bus interface of the CPU 701 and a driving signal for the fixation heater is generated according to the ON/OFF time period and duty set by the CPU 701. Since the driving signal generated by the PWM controller 705 is at a DC level, the heater 203 is finally AC-controlled by the heater driving circuit 706.

Figure 9:
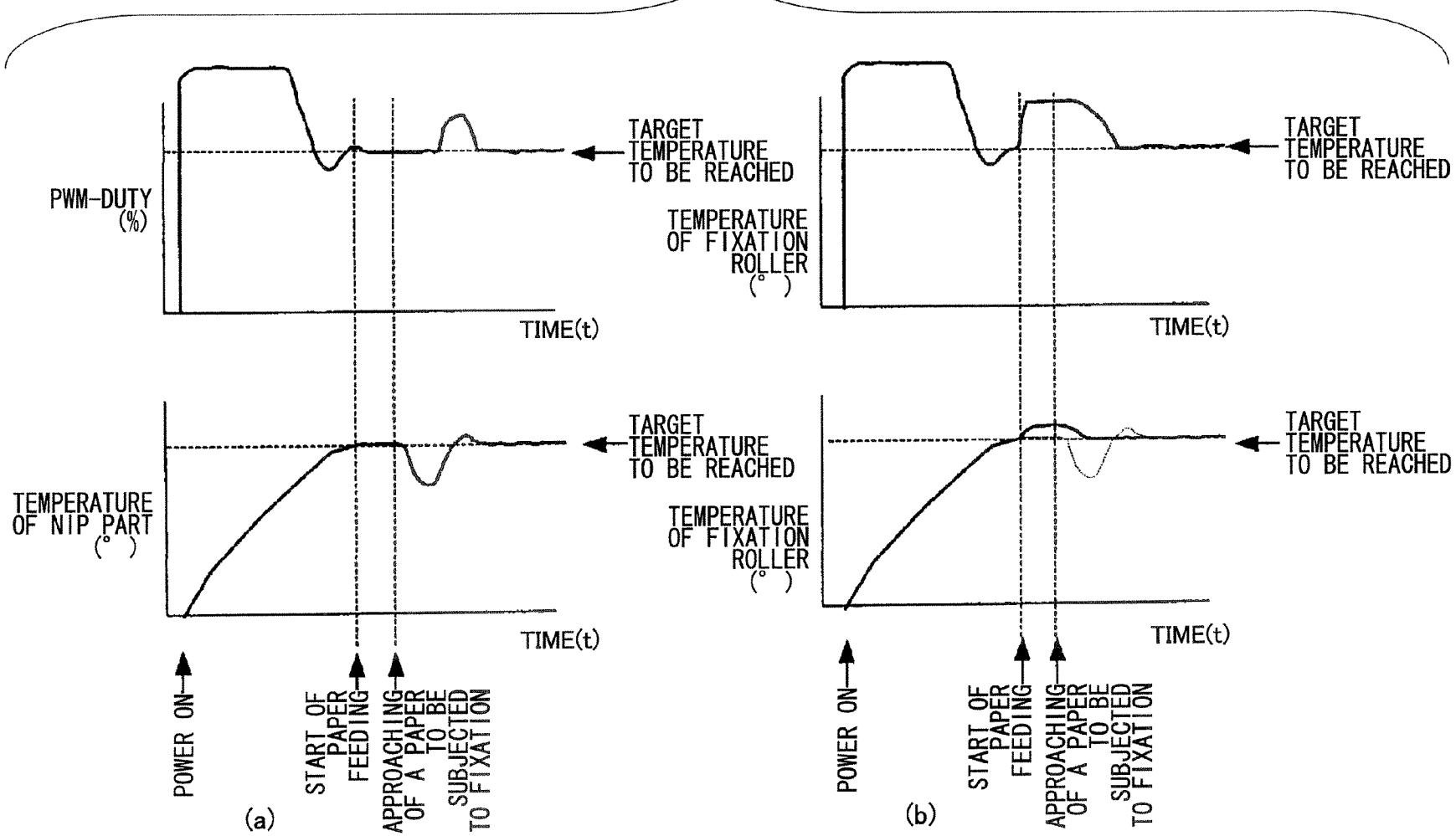
FIG. 9 is a graph showing one example of control results, wherein (a) shows the result of conventional control and (b) shows the result of control when an embodiment of the present invention is used.

FIG. 9 is a graph showing one example of control results, wherein (a) shows the result of conventional control and (b) shows the result of control when the embodiment of the present invention is used. Each shows the output of the PWM controller 705 under an environment of lower temperature and the temperature change of the nip part. At the time of turning on of the power supply of the body, a control is made while the duty of the PWM is improved, in order to quickly reach the target temperature, and after reaching the target temperature, a printing operation is started. When the printing operation is started and the transcription paper 207 approaches the fixation roller, the temperature of the nip part temporally lowers as shown in (a) in the case of a conventional control.

However, when the embodiment of the present invention is used, since the radius of the driven roller decreases under an environment of lower temperature as described above, the rotational velocity of the driven roller increases at a time when the transcription paper 207 is conveyed in the vertical conveyance unit 116, and, therefore, the duty of the PWM is controlled to be high such that the temperature of the fixation heater is high as shown in FIG. 8. Accordingly, as shown in FIG. 9(*b*), when the transcription paper 207 is conveyed in the vertical conveyance unit 116, the temperature of the fixation roller 201 is preliminarily raised, and, even though the transcription paper 207 approaches the fixation roller 201 so as to lower the temperature of the nip part, it is not lowered below the target temperature and the ununiformity of fixation can be prevented.

As described above, the degradation of image quality caused by the temporal lowering of temperature can be prevented by controlling the surface temperature of the fixation roller 201 depending on the temperature of the transcription paper 207 before performing the fixation.

In the embodiment described above, although the process for detecting the rotational velocity of the driven roller 150 on the conveyance route for the transcription paper 207 before the transcription has been described, a driven roller on a transcription belt is applicable for an image forming apparatus such that a toner image on a photoconductor is transcribed on the transcription belt and the toner image on the transcription belt is transcribed on a transcription paper.

Figure 10:
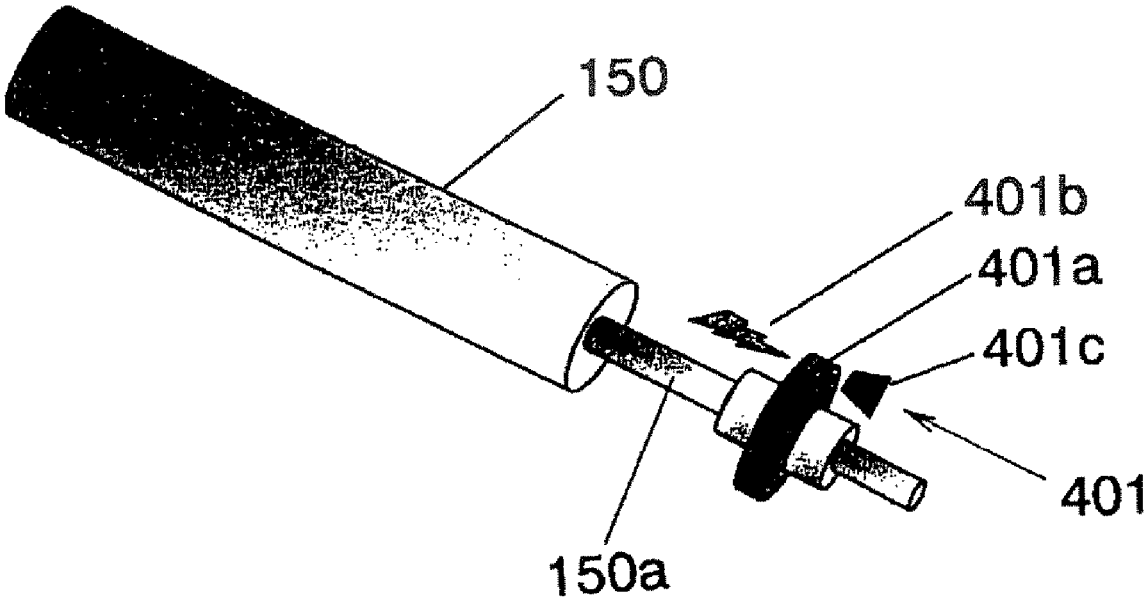
FIG. 10 is a perspective view that schematically shows another example of a driven roller.

Also, although the process for detecting the rotational velocity of the driven roller by measuring a time period of one rotation of the roller has been described, the number of an output pulse(s) of a sensor 401 in a predetermined time period may be measured by attaching a disk 401*a* on which plural slits are formed to a shaft 150*a* of a driven roller 150, arranging a light-emitting element 401*b* and a light-receiving element 401*c* so as to sandwich the disk 401*a*, and providing an encoder-shaped sensor 401 for generating a light pulse by using the slits, as shown in FIG. 10.

The first embodiment of the present invention can be applied to a fixation device for fixing a toner image on a recording medium by means of heating and pressurizing, an image forming apparatus such as a copying machine, a printer, a facsimile machine, and a digital multiple-function-processing machine, with such a fixation device, and a method of controlling heating of such a fixation device.

Second Embodiment

In the following second embodiment of the present invention, numerals 1200, 1100, 1104, and 1203 denote a control section, a driving section, a switching element, a safety device, respectively, and a pulse transformer 1204, the combination of a first and second photocouplers 1205 and 1206, and the combination of a heating control part including the driving section 1100 and the control section 1200 and a fixation part 1300 are used as a signal transmitting part, a part for detecting a resonance voltage waveform, and a fixation device, respectively.

Figure 11:
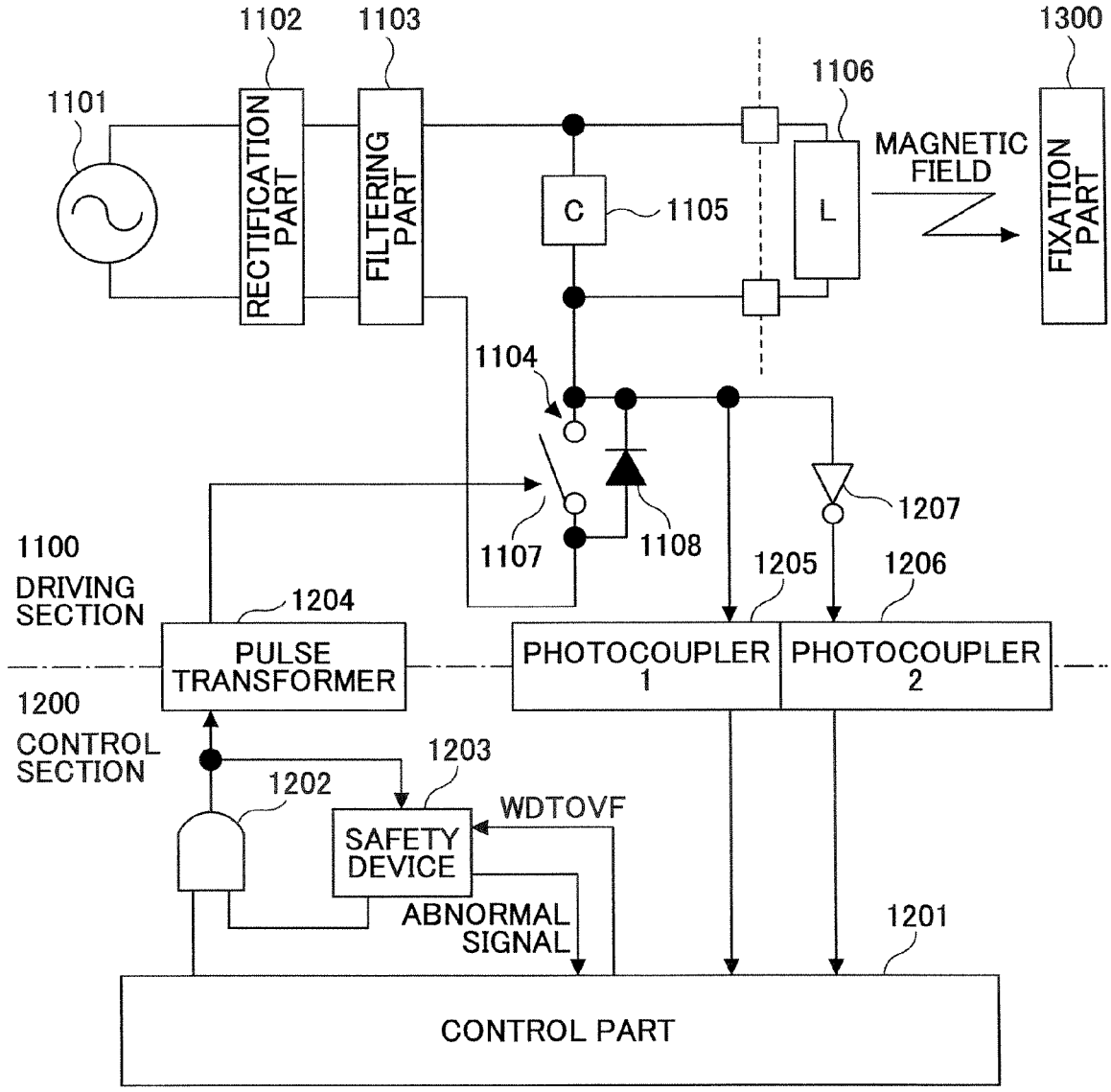
FIG. 11 is a schematic diagram showing a typical configuration of a fixation device according to an embodiment of the present invention.

FIG. 11 is a schematic diagram showing a typical configuration of a fixation device with an electrically inductive heating device according to the second embodiment of the present invention. In the figure, the electrically inductive heating device is composed of a driving section (primary section) 1100 and a control section (secondary section) 1200. The driving section 1100 is mainly composed of an alternating current power supply 1101, a rectification part 1102, a filtering part 1103, a switching element 1104, a resonance capacitor 1105 and a heating coil 1106, wherein the switching element 1104 is composed of a switch 1107 and a diode 1108 and the diode 1108 is connected to the switch 1107 in parallel. The control section 1200 is composed of a control part 1201, an AND circuit 1202 and a safety device 1203, wherein the output of the AND circuit 1202 is input into the pulse transformer 1204 and the safety device 1203. Additionally, a signal (driving pulse) from the control section 1200 is transmitted to the driving section 1100 in an electrically-insulated condition by the pulse transformer 1204. The resonance voltage waveform is transmitted from the driving section 1100 to the control section 1200 by the first and second photocouplers 1205 and 1206 and is detected in the control section 1201.

In such an electrically inductive heating device, a driving pulse is provided from the control part 1201 to the AND circuit 1202 and the output of the AND circuit 1202 is provided to the switching element 1104 through the pulse transformer 1204, whereby the switch 1107 is opened or closed. Then, alternating current is provided to or blocked from the heating coil 1106 by closing or opening the switch 1107. The diode 1108 is provided for blocking an inverse voltage applied between both ends of the switch 1107. Thus, the alternating current provided from the alternating current power supply 1101 is provided to the heating coil 1106 through the rectification part 1102 and the filtering part 1103. Then, an alternating magnetic field generating at the heating coil 1106 acts on a heating part 1300 (as a fixation part drawn in the figure) of a fixation roller, so as to generate eddy current in the heating part (fixation part) 1300, and, thereby, it is heated. Additionally, the fixation roller is described herein but a fixation belt including a heated object may be used.

Figure 12:
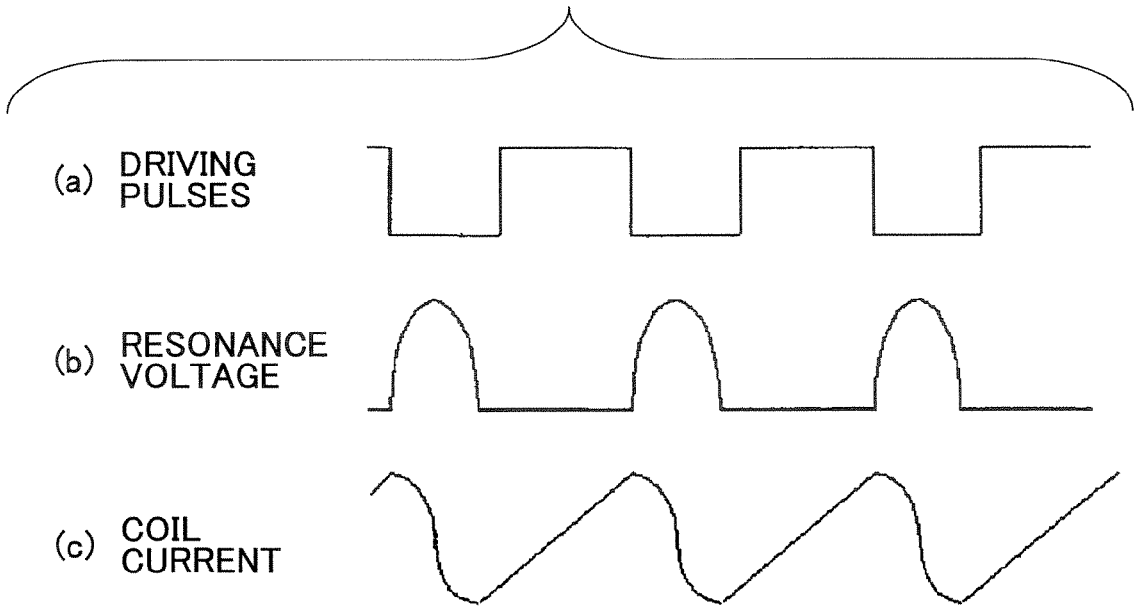
FIG. 12 is a diagram showing the conditions of driving pulses, a resonance voltage, and coil current in the embodiment.
Figure 13:
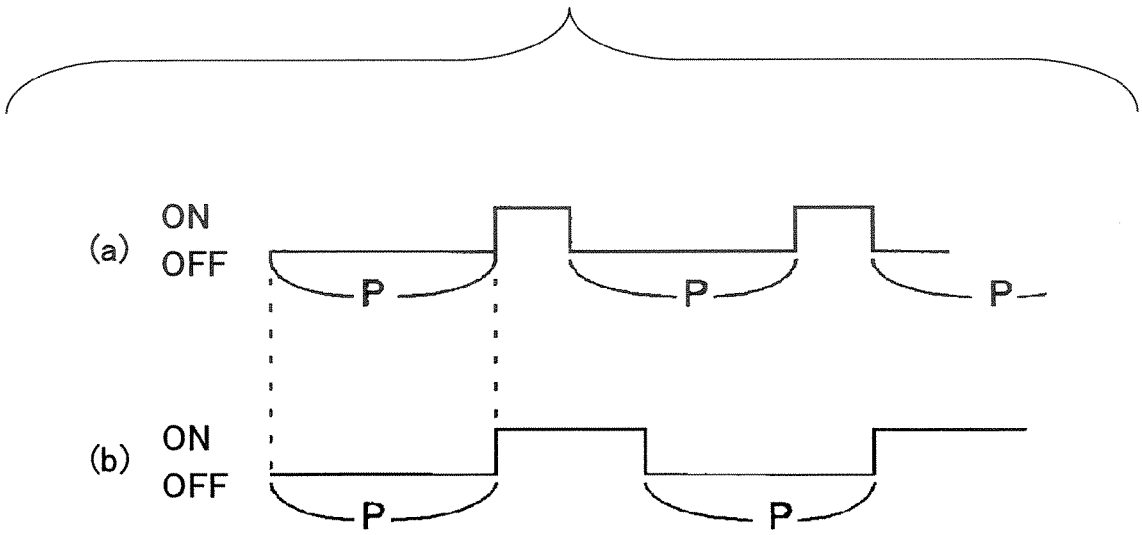
FIG. 13 is a diagram showing the condition of a driving wave pattern applied to an inverter.

Thus, a pulse for driving the switching element 1104 is generated by the control part 1201 of the control section 1200 so as to control the switching of the switching element 1104 via the pulse transformer 1204. In the control part 1201, driving pulses as shown in FIG. 12(*a*) are controlled by the pulse transformer 1204, whereby coil current as shown in FIG. 12(*c*) is generated in the heating coil 1106 and eddy current is generated in a heater of the fixation part 1300 by an alternating magnetic field generating from the heating coil 1106, so as to heat it. The longer the on-time period of the driving pulse is, heating energy becomes higher. As described above, a resonance voltage is generated between both ends of the switching element 1104 at the time of turning off the driving pulses as shown in FIG. 12(*b*), and the duration thereof is determined by the values of the heating coil 1106 and resonance capacitor 1105. Then, the control part 1201 is controlled to provide an off-time period longer than the duration of the resonance voltage as shown in FIG. 14(*a*) and not to turn on the switching element 1104 during the generation of a resonance voltage thereon.

Figure 14:
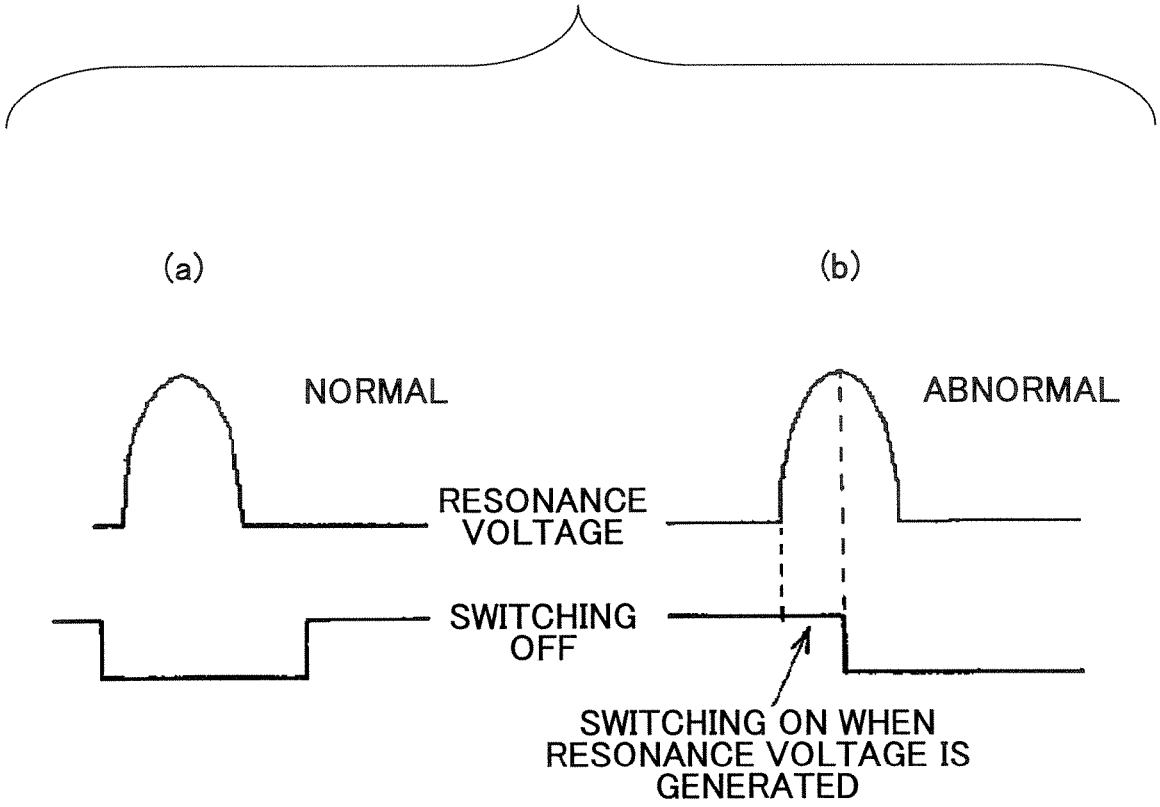
FIG. 14 is a diagram showing the relationship between a resonance voltage and a switching operation.

However, as described above, where an abnormal event occurs in the control part 1201 and the off-time period decreases, the switching element 1104 is turned on during the generation of a resonance voltage as shown in FIG. 14(*b*), whereby significant stress is applied on the switching element 1104, which may be led to breaking thereof.

Then, in the embodiment, timing of turning off the switching element 1104 is detected and the safety device 1203 has a function such that the switching element 1104 is not turned on during a predetermined time period after turning off thereof. As the safety device 1203 has such a function, turning on of the switching element 1104 during the generation of the resonance voltage can be avoided and the degradation and breaking of the switching element 1104 can be prevented.

An abnormal event in the control part 1201 is sensed by input of a watchdog timer overflow (WDTOVF) signal into the safety device 1203. That is, in the embodiment, as the watchdog timer overflow (WDTOVF) signal is input into the safety device 1203, the safety device 1203 outputs a low level signal into the AND circuit 1202. Thus, since the output of the AND circuit 1202 becomes a low level and no driving signal is output to the pulse transformer 1204, the switching element 1104 is not driven (turned on). Therefore, when the resonance voltage is output as shown in FIG. 14(*b*), the switching element 1104 is not driven and the abnormality is not enhanced.

Also, the output from the AND circuit 1202 is input into the safety device 1203 as seen in FIG. 11. Accordingly, when the output of the AND circuit is at a high level, in other words, when the safety device 1203 monitors a time period of turning on the switching element 1104 and a time period of turning on over a predetermined certain time period is sensed, an abnormal signal is output to the control part 1201. Accordingly, the control part 1201 lowers the level of a driving pulse into the pulse transformer 1204 to a low level. As a result, the switching element 1104 is turned off. Thus, as the switching element 1104 is once turned off, the safety device 1203 subsequently continues to output the abnormal signal over a certain time period. Accordingly, an OFF state is retained over the certain time period, during which no return to an abnormal state is conducted.

Thus, even when an abnormal event occurs in the control part 1201, no switching operation affects the resonance voltage by the safety device 1203, and in the embodiment, the first and second photocouplers 1205 and 1206 are further provided such that the resonance voltage waveform is monitored by the first and second photocouplers 1205 and 1206 and the safety is further maintained.

That is, an output of the first photocoupler 1205 connected to an end of the switching element 1104 and an output of the second photocoupler 1206 connected to the first photocoupler 1205 in parallel and an inverter 1207 in series are input into the control part 1201. The first photocoupler 1205 conducts sensing of the voltage waveform of a resonance voltage applied on the switching element 1104, and when the resonance voltage disappears, the output becomes HIGH and the HIGH signal is input into the control part 1201. Accordingly, the control part 1201 stops the output of a driving pulse to the pulse transformer 1204.

On the other hand, the second photocoupler 1206 is connected to the inverter 1207 in series, and therefore, senses a voltage waveform inverse to that of the first photocoupler 1205. That is, as a resonance voltage is applied on the switching element 1104, the output becomes HIGH and the HIGH signal is input into the control circuit 1201. While the output is HIGH, the control part 1201 outputs a driving pulse to the pulse transformer 1204 and a switching operation of the switching element 1104 is conducted.

Thus, if a part for transmitting the occurrence of an abnormal event in the control part 1201, in the embodiment, the safety device 1203, is included, the control part 1201 can detect the occurrence of an abnormal event.

Also, the safety device 1203 includes a function to detect timing of turning on the switching element 1104 and not to turn on the switching element 1104 over a predetermined time period (which is composed of the AND circuit and the safety circuit 1203 in the embodiment) and the timing of turning on the switching element 1104 is prevented from overlapping the timing of generating the resonance voltage, whereby the deterioration or breaking of the switching element 1104 can be prevented. Also, since the occurrence of an abnormal event in the control part 1201 is transmitted from the safety device 1203 to the control part 1201 by an abnormal signal, the control part 1201 can detect the occurrence of an abnormal event.

Further, since the safety device 1203 has a function to detect an abnormal signal of the control part 1201, for example, a watchdog timer overflow WDTOVF signal, a malfunction of the electrically inductive heating fixation device can be prevented when an abnormal event occurs in the control part 1201.

In addition, since the lowering of a resonance voltage can be transmitted to the control part 1201 by the first photocoupler 1205, the control part 1201 can make a control such that the switching element 1104 is not turned on during the generation of the resonance voltage.

On the other hand, when the generation of a resonance voltage is transmitted to the control part 1201 by using the photocoupler and a time period of generation of the resonance voltage is detected, the precision thereof is deteriorated due to the temperature change over an off-time period of the photocoupler, etc. In order to address the problem, the two photocouplers 1204 and 1206 are used and utilized in reversed polarities in the embodiment, and signals at the time of turning on the photocouplers 1204 and 1205 are utilized for the rising and dropping of a resonance voltage so that the precision of detection of a generating time period of the resonance voltage can be improved.

According to the configuration of the embodiment, exerted are some effects such that 1) since the control section includes a part for retaining a certain or longer off-time period of pulses, the deterioration or breaking of a switching element can be prevented;

2) since the control section includes a part for retaining a certain or shorter on-time period of a pulse, the deterioration or breaking of a switching element can be prevented;

3) since a part for imperatively stopping the output of a pulse is included when the control part does not function, a malfunction of an electrically inductive heating fixation device can be prevented when an abnormal event occurs in the control part;

4) since a resonance voltage waveform is detected in the control section by using a signal transmitting part having an electrically insulating function, the state of the resonance voltage can be added in control factors; and 5) since two photocouplers are used in reversed polarities, the influence of distortion such as a temperature change of an off-time period of the photocoupler can be reduced.

The second embodiment of the present invention can be applied to a fixation device in which an electrically inductive heating is used for generating electrically inductive current in an electrical conductor in immediate proximity to an electric coil (electrically conductive coil) by applying alternating current thereon, particularly, a fixation device which uses the electrically inductive heating control of a PWM control for supplying an electrical power to a resonance circuit including an electrically inductive heating coil and a resonance capacitor connected thereto by chopping direct current for which alternating current is rectified, using an inverter, and an image forming apparatus such as a printer, a copying machine, a facsimile machine and a digital multiple function processing machine with a composite function thereof, which uses the fixation device.

[Appendix]

Typical embodiments (1-1) to (1-12) of the present invention are described below.

(1-1) An image forming apparatus comprising a fixation device having a heating part configured to heat and fix a toner image formed on a recording medium, characterized by comprising a rotational velocity detecting part configured to detect a rotational velocity of a conveyance roller configured to convey the recording medium and a control part configured to estimate a surface temperature of the recording medium based on the rotational velocity of the conveyance roller detected by the rotational velocity detecting part, to estimate a temperature change of the heating part at a time of fixation based on the estimated surface temperature, and to determine a heating control variable of the heating part based on the temperature change.

(1-2) The image forming apparatus as described in (1-1) above, characterized in that the rotational velocity detecting part comprises a sensor configured to output a signal for each rotation of the conveyance roller and a counting part configured to count an output of the sensor in a predetermined time period.

(1-3) The image forming apparatus as described in (1-2) above, characterized in that the sensor is provided on a driven roller as a conveyance roller.

(1-4) The image forming apparatus as described in (1-3) above, characterized in that the sensor comprises a light blocking member provided on a shaft of the driven roller and a detecting part configured to detect a light blocking condition of the light blocking member for each rotation thereof.

(1-5) The image forming apparatus as described in (1-1) above, characterized in that the rotational velocity detecting part comprises a disk having plural slits through which light passes and co-axially provided on a shaft of the conveyance roller, a slit detecting part configured to output a signal every time when a slit on the disk is detected, and a counting part configured to count an output of the slit detecting part in a predetermined time period.

(1-6) The image forming apparatus as described in any of (1-1) to (1-5) above, characterized in that the control part determines a surface temperature of a sheet and an estimated temperature change and heating control variable of the heating part by an operation based on information of the rotational velocity of the conveyance roller.

(1-7) The image forming apparatus as described in any of (1-1) to (1-6) above, characterized by further comprising a storage part which preliminarily stores a heating control variable determined by information of a rotational velocity of the conveyance roller, wherein the control part determines the heating control variable based on a table value in the storage part which is based on the information of the rotational velocity of the conveyance roller.

(1-8) The image forming apparatus as described in any of (1-1) to (1-7) above, characterized in that the conveyance roller is made of a metal with a high heat-conductivity.

(1-9) The image forming apparatus as described in any of (1-1) to (1-7) above, characterized in that the heating part comprises a halogen heater.

(1-10) The image forming apparatus as described in any of (1-1) to (1-7) above, characterized in that the heating part comprises an electrically inductive heating part.

(1-11) A method of controlling heating of a fixation device having a heating part configured to heat and fix a toner image formed on a recording medium, characterized by comprising detecting a rotational velocity of a conveyance roller configured to convey the recording medium, estimating a surface temperature of the recording medium based on the detected rotational velocity of the conveyance roller, estimating a temperature change of the heating part at a time of fixation based on the estimated surface temperature, and determining a heating control variable of the heating part based on the estimated temperature change.

(1-12) The method of controlling heating of a fixation device as described in (1-11) above, characterized in that the conveyance roller whose rotational velocity is detected is a driven roller.

According to any of typical embodiments (1-1) to (1-12) above, it may be possible to prevent degradation of image quality caused by temporal lowering of surface temperature of a fixation roller or degradation of image quality under a lower temperature environment.

Other typical embodiments (2-1) to (2-12) of the present invention are described below.

(2-1) A fixation device comprising an electrically inductive heating part configured to generate a driving wave pattern for a switching element by a control part in a control section thereof and to transmit the driving wave pattern to a driving section thereof by a signal transmitting part having an insulating function provided between the driving section and the control section, characterized by comprising a part configured to retain a certain or longer off-time period of a driving pulse for the switching element, in the control section.

(2-2) The fixation device as described in (2-1) above, characterized in that the part configured to retain a certain or longer off-time period comprises a safety device configured to detect a timing of turning off the switching element and not to turn on the switching element during a predetermined time period after turning off thereof.

(2-3) A fixation device comprising an electrically inductive heating part configured to generate a driving wave pattern for a switching element by a control part in a control section thereof and to transmit the driving wave pattern to a driving section thereof by a signal transmitting part having an insulating function provided between the driving section and the control section, characterized by comprising a part configured to retain a certain or shorter on-time period of a driving pulse for the switching element, in the control section.

(2-4) The fixation device as described in (2-3) above, characterized in that the part configured to retain a certain or shorter on-time period comprises an AND circuit to which a driving pulse from the control part is input and which outputs it to the driving section and a safety device configured to monitor an on-output of the driving pulse from the AND circuit and output an abnormal signal to said control part when the on-output continues during a preliminarily set time period or longer.

(2-5) A fixation device comprising an electrically inductive heating part configured to generate a driving wave pattern for a switching element by a control part in a control section thereof and to transmit the driving wave pattern to a driving section thereof by a signal transmitting part having an insulating function provided between the driving section and the control section, characterized by comprising a part configured to imperatively stop an output of a driving pulse when the control part does not function.

(2-6) The fixation device as described in (2-5) above, characterized in that the part configured to imperatively stop an output of a driving pulse is a safety device configured to output an abnormal signal to the control part.

(2-7) A fixation device comprising an electrically inductive heating part configured to generate a driving wave pattern for a switching element by a control part in a control section thereof and to transmit the driving wave pattern to a driving section thereof by a signal transmitting part having an insulating function provided between the driving section and the control section, characterized by comprising a part configured to imperatively stop an output of a driving pulse when the control part is abnormal.

(2-8) The fixation device as described in (2-7) above, characterized in that the part configured to imperatively stop an output of a driving pulse is a safety device configured to stop an output of a driving pulse to the driving section when a watchdog timer overflow signal is received from the control part.

(2-9) A fixation device comprising an electrically inductive heating part configured to generate a driving wave pattern for a switching element by a control part in a control section thereof and to transmit the driving wave pattern to a driving section thereof by a signal transmitting part having an insulating function provided between the driving section and the control section, characterized by comprising a part configured to detect a resonance voltage wave pattern in the control part by using the signal transmitting part having an insulating function.

(2-10) The fixation device as described in (2-9) above, characterized in that the part configured to detect a resonance voltage wave pattern is a photocoupler.

(2-11) The fixation device as described in (2-10) above, characterized by comprising two of the photocouplers, both of which are used in reversed polarities.

(2-12) An image forming apparatus characterized by comprising the fixation device as described in any of (2-1) to (2-11) above.

According to any of typical embodiments (2-1) to (2-12) above, it may be possible to prevent a switching element from breaking since the switching element may be turned on when a resonance voltage is generated.

The present invention is not limited to the specifically disclosed embodiments, and variations and modifications may be made without departing from the scope of the present invention.

The present application is based on Japanese priority application No. 2005-310103 filed on Oct. 25, 2005 and Japanese priority application No. 2005-316996 filed on Oct. 31, 2005, the entire contents of which are hereby incorporated by reference.

What is claimed is:

1. An image forming apparatus comprising a fixation device having a heating part configured to heat and fix a toner image formed on a recording medium, a rotational velocity detecting part configured to detect a rotational velocity of a conveyance roller configured to convey the recording medium, and a control part configured to estimate a surface temperature of the recording medium based on the rotational velocity of the conveyance roller detected by the rotational velocity detecting part, to estimate a temperature change of the heating part at a time of fixation based on the estimated surface temperature, and to determine a heating control variable of the heating part based on the temperature change.

2. The image forming apparatus as claimed in claim 1, wherein the rotational velocity detecting part comprises a sensor configured to output a signal for each rotation of the conveyance roller and a counting part configured to count an output of the sensor in a predetermined time period.

3. The image forming apparatus as claimed in claim 2, wherein the sensor is provided on a driven roller as a conveyance roller.

4. The image forming apparatus as claimed in claim 3, wherein the sensor comprises a light blocking member provided on a shaft of the driven roller and a detecting part configured to detect a light blocking condition of the light blocking member for each rotation thereof.

5. The image forming apparatus as claimed in claim 1, wherein the rotational velocity detecting part comprises a disk having plural slits through which light passes and co-axially provided on a shaft of the conveyance roller, a slit detecting part configured to output a signal every time when a slit on the disk is detected, and a counting part configured to count an output of the slit detecting part in a predetermined time period.

6. The image forming apparatus as claimed in claim 1, wherein the control part determines a surface temperature of a sheet and an estimated temperature change and heating control variable of the heating part by an operation based on information of the rotational velocity of the conveyance roller.

7. The image forming apparatus as claimed in claim 1, which further comprises a storage part which preliminarily stores a heating control variable determined by information of a rotational velocity of the conveyance roller, wherein the control part determines the heating control variable based on a table value in the storage part which is based on the information of the rotational velocity of the conveyance roller.

8. The image forming apparatus as claimed in claim 1, wherein the conveyance roller is made of a metal with a high heat-conductivity.

9. The image forming apparatus as claimed in claim 1, wherein the heating part comprises a halogen heater.

10. The image forming apparatus as claimed in claim 1, wherein the heating part comprises an electrically inductive heating part.

11. A method of controlling heating of a fixation device having a heating part configured to heat and fix a toner image formed on a recording medium, which comprises detecting a rotational velocity of a conveyance roller configured to convey the recording medium, estimating a surface temperature of the recording medium based on the detected rotational velocity of the conveyance roller, estimating a temperature change of the heating part at a time of fixation based on the estimated surface temperature, and determining a heating control variable of the heating part based on the estimated temperature change.

12. The method of controlling heating of a fixation device as claimed in claim 11, wherein the conveyance roller whose rotational velocity is detected is a driven roller.

* * * * *